US010775109B2

(12) United States Patent
Nelson et al.

(10) Patent No.: US 10,775,109 B2
(45) Date of Patent: Sep. 15, 2020

(54) HEAT EXCHANGER ASSEMBLY

(71) Applicants: N. D. Nelson, Rowley, MA (US); Vincent J. Milano, Middleton, MA (US); Gregory G. Beninati, Salem, NH (US); Cameron B. Goddard, Lexington, MA (US); Matthew D. Thoren, Tyngsboro, MA (US); Edward I. Holmes, Acton, MA (US)

(72) Inventors: N. D. Nelson, Rowley, MA (US); Vincent J. Milano, Middleton, MA (US); Gregory G. Beninati, Salem, NH (US); Cameron B. Goddard, Lexington, MA (US); Matthew D. Thoren, Tyngsboro, MA (US); Edward I. Holmes, Acton, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 16/014,302

(22) Filed: Jun. 21, 2018

(65) Prior Publication Data

US 2018/0306522 A1 Oct. 25, 2018

Related U.S. Application Data

(62) Division of application No. 12/317,859, filed on Dec. 30, 2008, now abandoned.

(51) Int. Cl.
*F28D 15/04* (2006.01)

(52) U.S. Cl.
CPC ..... *F28D 15/046* (2013.01); *Y10T 29/49353* (2015.01)

(58) Field of Classification Search
CPC ..... F28D 15/046
See application file for complete search history.

(56) References Cited

U.S. PATENT DOCUMENTS

| | | | | |
|---|---|---|---|---|
| 4,067,315 | A * | 1/1978 | Fehlner | F28D 15/04 126/636 |
| 6,901,994 | B1 * | 6/2005 | Jin-Cherng | F28D 15/046 165/104.26 |
| 7,002,247 | B2 * | 2/2006 | Mok | H01L 23/427 257/625 |
| 7,180,179 | B2 * | 2/2007 | Mok | H01L 23/427 257/675 |
| 7,770,633 | B2 * | 8/2010 | Miyahara | F28D 15/046 165/128 |
| 2003/0115753 | A1 * | 6/2003 | Klett | B32B 5/18 29/890.03 |
| 2006/0096740 | A1 * | 5/2006 | Zheng | F28D 15/0233 165/104.26 |
| 2007/0006993 | A1 * | 1/2007 | Meng | F28D 15/0233 165/104.26 |
| 2007/0089865 | A1 * | 4/2007 | Rosenfeld | B22F 3/1103 165/104.26 |
| 2008/0078531 | A1 | 4/2008 | Chung et al. | |

(Continued)

*Primary Examiner* — Devon Russell

(57) ABSTRACT

An improved heat exchanger assembly and method. First and second plates made of a predetermined thermally conductive material are configured when mated to form a hermetically sealed vapor chamber. A wick made of the same predetermined thermally conductive material resides in the vapor chamber forming a gas chamber.

20 Claims, 9 Drawing Sheets

(56) References Cited

U.S. PATENT DOCUMENTS

| | | | | |
|---|---|---|---|---|
| 2008/0128116 | A1* | 6/2008 | Dangelo | F28D 15/046 165/104.21 |
| 2008/0225489 | A1* | 9/2008 | Cai | F28D 15/0266 361/704 |
| 2009/0056917 | A1* | 3/2009 | Majumdar | F28D 15/0233 165/104.26 |
| 2009/0159243 | A1* | 6/2009 | Zhao | F28D 15/046 165/104.26 |
| 2010/0084113 | A1* | 4/2010 | Lee | F28D 15/046 165/46 |
| 2010/0243214 | A1* | 9/2010 | Moon | F28D 15/0233 165/104.26 |
| 2010/0258278 | A1* | 10/2010 | Moon | H01L 23/427 165/104.26 |

* cited by examiner

HEAT EXCHANGER ASSEMBLY

PRIORITY CLAIM

This application is a division of U.S. Non-Provisional patent application Ser. No. 12/317,859 filed Dec. 30, 2008.

TECHNICAL FIELD

The present disclosure relates to heat transfer, heat exchanger assemblies, and cold plates.

BACKGROUND OF THE DISCLOSURE

Heat exchangers are used to cool electronic components generating heat. In one example, a cold plate assembly used in connection with radar transmit and receive modules is made of aluminum and includes therein copper heat pipes.

One problem with copper is that it is heavy, which is a concern in ship and airborne applications. Historically, aluminum can be used for the cold plate housing, allowing weight optimization, but when integrated with the copper heat pipe can introduce the possibility for galvanic corrosion. When solder, or other materials, are used as the barrier material between the cold plate housing and heat pipe, voids introduce thermal resistances, contribute to local galvanic corrosion opportunity, and reliability problems. Moreover, the current process of making the cold plates limits design flexibility and is labor intensive and expensive. Copper is also becoming increasingly costly.

Aluminum heat pipes available on the market today suffer from reduced thermal efficiency. When integrated with aluminum cold plates, the dissimilar metal problem is solved and the possibility for galvanic corrosion is reduced to, but the result is reduced thermal performance. This reduced performance limits applications. Additionally, these heat pipes suffer from poor reliability and manufacturability issues. Attempts at plating either aluminum or copper cold plates and copper heat pipes with a tin-lead composition to eliminate corrosion resulted in additional thermal interfaces, an added expense, and additional manufacturing steps.

Given that in a radar assembly there can be thousands of cold plates, a new cold plate technology would be beneficial.

SUMMARY OF THE DISCLOSURE

It is therefore an object of this disclosure to provide an improved heat exchanger assembly.

It is a further object of this disclosure to provide such a heat exchanger assembly which does not suffer from galvanic corrosion.

It is a further object of the subject disclosure to provide such an assembly which exhibits improved reliability.

It is a further object of the subject disclosure to provide such an assembly which exhibits a lower thermal resistance.

It is a further object of the subject disclosure to provide such an assembly which can be manufactured easily and at a lower cost.

It is a further object of the subject disclosure to provide such a heat exchanger assembly which can be made lighter.

It is a further object of the subject disclosure to provide such an assembly which has a higher cooling capacity.

It is a further object of the subject disclosure to provide such an assembly which can be tailored to any desired shape and with an integral vapor chamber configured to meet the thermal and mechanical design requirements as well as cost goals and other needs of the design community.

It is a further object of the subject disclosure to provide such an improved heat exchanger assembly which acts as a synergistic structure, providing both improved structural and thermal dissipation properties.

It is a further object of the subject disclosure to provide such a heat exchanger which serves, in one particular example, as a cold plate for radar transmitter and receiver module.

The present disclosure results from the partial realization that, in one example, all the materials used in a heat exchanger (e.g., a cold plate) can be the same to prevent galvanic corrosion if metal foam is used as the wick and stir welding is used to hermetically seal the vapor chamber in which the metal foam resides.

The subject disclosure features an improved heat exchanger assembly comprising first and second plates made of a predetermined thermally conductive material such as aluminum configured when mated to form a hermetically sealed vapor chamber. In one application, a wick made of the same predetermined thermally conductive material resides in the vapor chamber forming a gas chamber. In one example, the wick is foamed aluminum.

The wick could also be braided. Typically, the wick lines the vapor chamber. In one preferred embodiment, a peripheral stir weld is used to hermetically seal the first and second plates. Also, brazing could be used to hermetically seal the first and second plates. There is usually a port into the vapor chamber and a plug made of the same predetermined material inertia welded forming a hermetic seal. The predetermined material used could also include copper, carbon, or other materials. Typically, the wick is attached to the walls of the vapor chamber. The wick can be brazed, bonded, or foamed in place to the walls of the vapor chamber. Advantageously, the wick can be compressed or formed (e.g., machined) into a desired shape. The wick can include fins and the fins may include nanotubes. In one particular example, first and second plates made of aluminum are configured when mated to form a hermetically seals vapor chamber, an aluminum foam wick lines the vapor chamber forming a gas chamber, and a peripheral stir weld hermetically seals the first and second plates.

The subject disclosure also features an improved heat exchanger assembly including a structure made of a predetermined thermally conductive material forming a hermetically sealed vapor chamber therein and a wick made of the same or a galvanically compatible thermally conductive material in the vapor chamber forming a gas chamber. In one particular example, the structure includes first and second plates configured (e.g., via cavities formed in each plate) when mated to form the hermetically sealed vapor chamber between the plates.

The subject disclosure also features a method of making an improved heat exchanger assembly. One preferred method includes forming cavities in first and second plates made of a predetermined thermally conductive material which when mated form a vapor chamber between the plates. A wick made of the predetermined thermally conductive material is inserted in the vapor chamber to form a gas chamber. Ultimately, the vapor chamber is hermetically sealed typically by stir welding.

Typically, the wick is foamed or braided aluminum, copper, carbon, or some other material. Hermetically sealing the vapor chamber by brazing the plates is also a viable method. A port into the vapor chamber is sealed using inertia welding of a plug preferably made of the same predetermined material.

The subject disclosure also includes a three dimensional scaleable, flexible form factor integrated vapor chamber, joined by friction stir welding, yielding a synergistic structure that optimizes mechanical strength and thermal properties.

The subject disclosure also can be constructed of one, two, or more plates when mated form a chamber, or chambers. A wick made of a predetermined thermally conductive material is inserted in the vapor chamber, or chambers, to form a gas chamber(s). Ultimately, the vapor chamber is hermetically sealed typically by friction stir welding.

Additional manufacturing processes can be leveraged to create the vapor chamber in one or more plates. Such examples include gun drilling, casting, machining, EDM, etc. The wick may include fins and the fins may include nanotubes.

The subject disclosure, however, in other embodiments, need not achieve all these objectives and the claims hereof should not be limited to structures or methods capable of achieving these objectives.

BRIEF DESCRIPTION OF THE DRAWINGS

Other objects, features and advantages will occur to those skilled in the art from the following description of a preferred embodiment and the accompanying drawings, in which.

DETAILED DESCRIPTION

Figure 1:
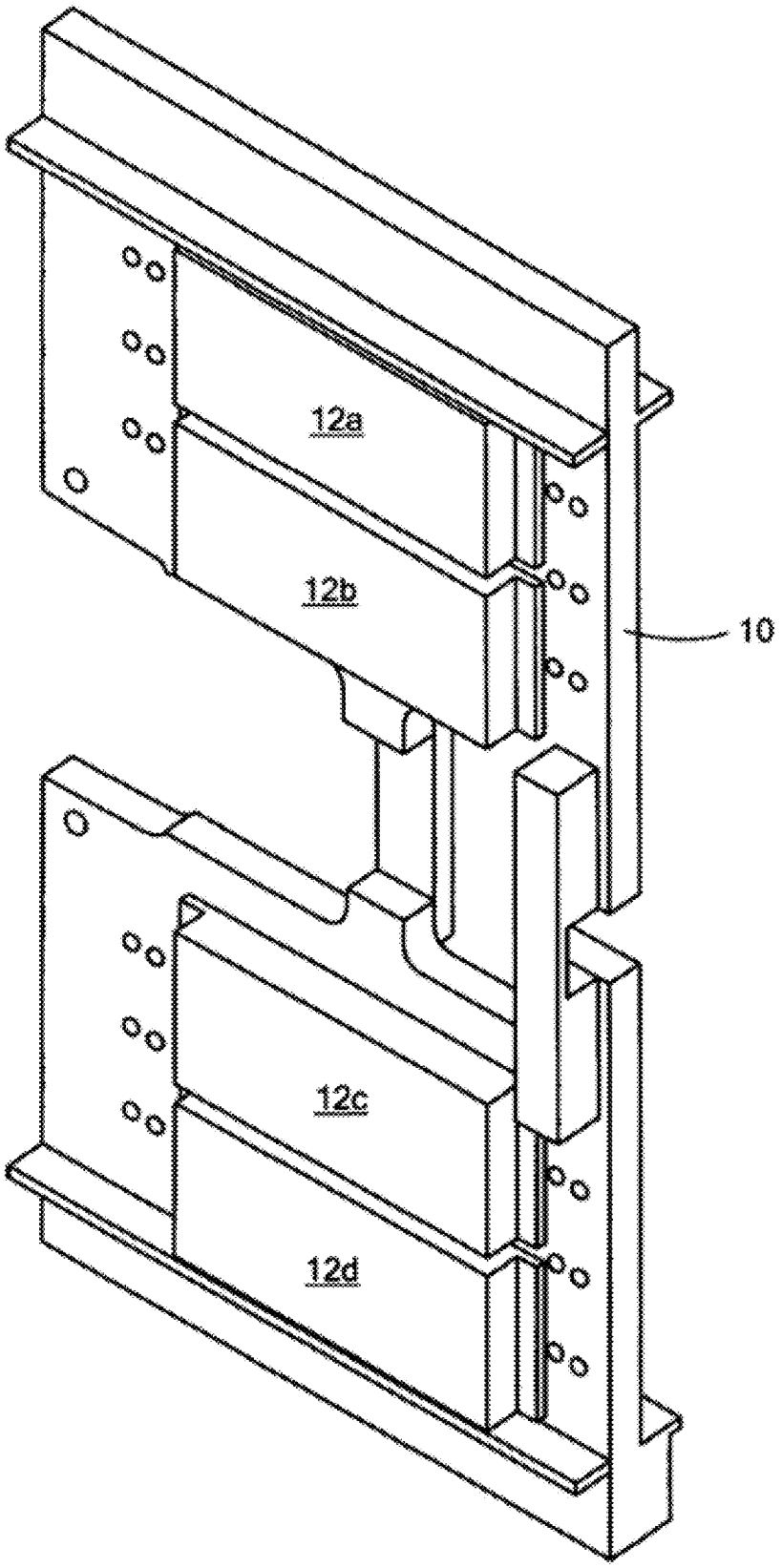
FIG. 1 PRIOR ART
FIG. 1 is a schematic three-dimensional front view of a prior art cold plate used in connection with radar transmit and receive modules.

Aside from the preferred embodiment or embodiments disclosed below, this disclosure is capable of other embodiments and of being practiced or being carried out in various ways. Thus, it is to be understood that the disclosure is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
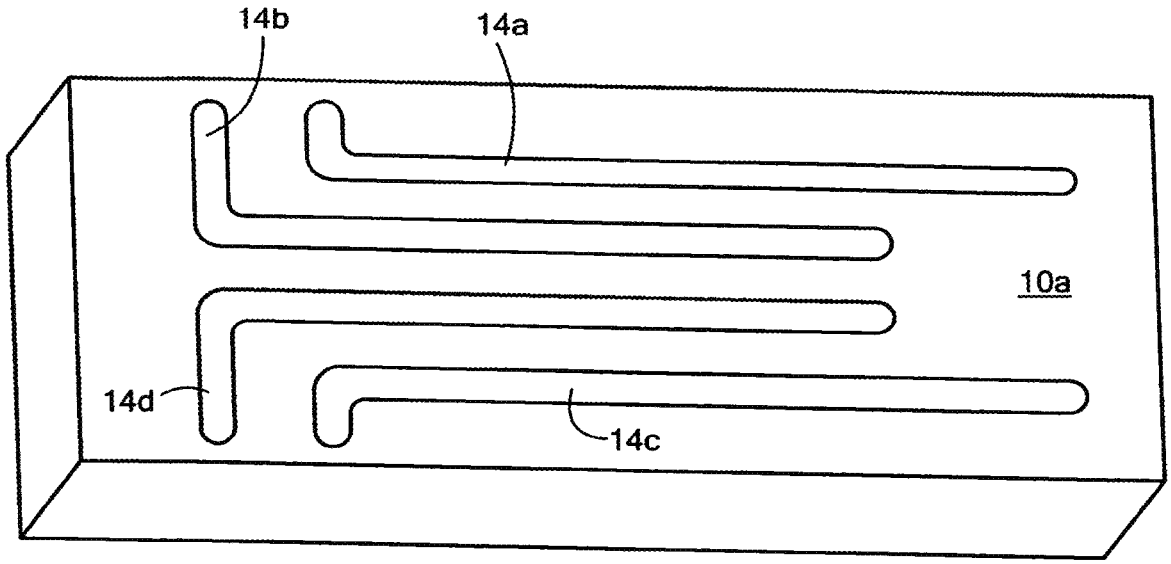
FIG. 2 PRIOR ART
FIG. 2 is a highly schematic top view showing one portion of the cold plate shown in FIG. 1.
Figure 3:
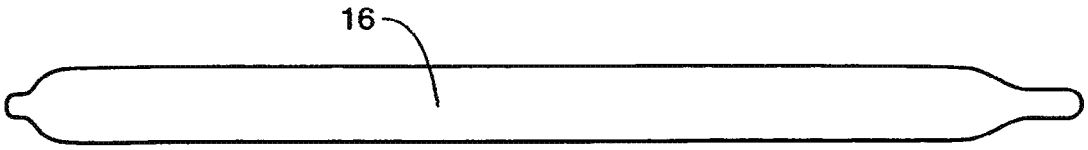
FIG. 3 PRIOR ART
FIG. 3 is a highly schematic front view of a prior art heat pipe used in connection with the cold plate shown in FIGS. 1-2.
Figure 4:
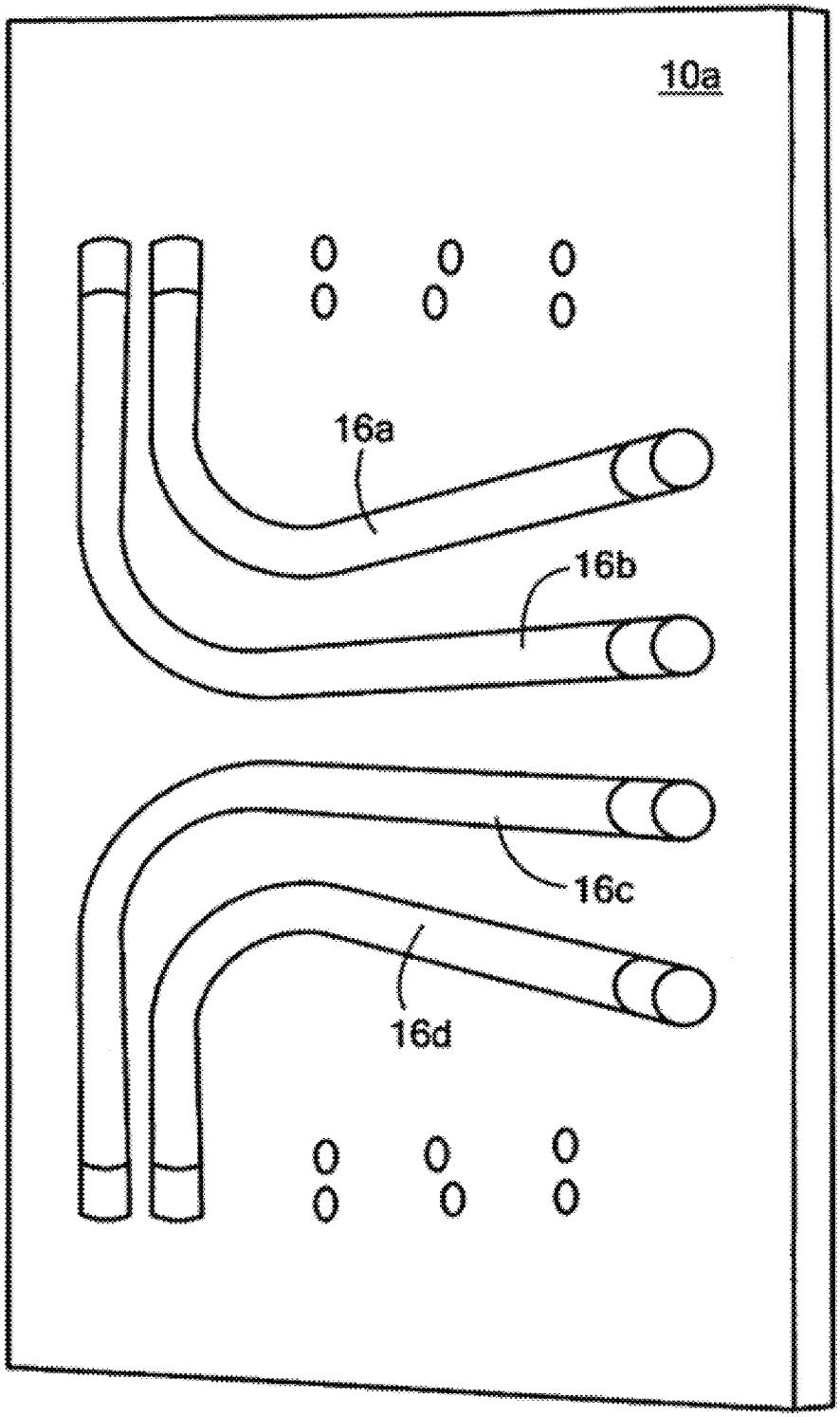
FIG. 4 PRIOR ART
FIG. 4 is a schematic top view showing four heat pipes installed in a cold plate.

There is shown in FIG. 1 an example of a prior art cold plate 10 for radar transmit and receive modules 12*a*-12*d*. Cold plate 10 typically includes two halves one of which is schematically shown in FIG. 2. Cold plate half 10*a*, typically made of aluminum, is machined to form channels as shown at 14*a*-14*b* then nickel under plated with gold over plated. The other cold plate half is machined and plated in a similar fashion to form mirror image channels. Copper heat pipes such as heat pipe 16, FIG. 3 are then laid in the channels as shown in FIG. 4. The other cold plate half is then mated onto cold plate half 10*a* using solder paste spread over the machined faces of the cold plate halves.

As explained in the background section above, one problem with copper used as the cold plate material is that it is heavy which is a concern in ship and airborne applications. When aluminum is used instead for the cold plate material, the copper heat pipes 16*a*-16*d*, FIG. 4 therein resulted in a galvanic mismatch which can then lead to corrosion and reliability problems. The use of different materials in a heat exchanger can also increase the thermal resistance of the assembly. Moreover, the process of making a cold plate such as the one shown in FIG. 1 can be labor intensive and costly. Other problems associated with the prior art discussed more fully in the background section above.

Figure 5A:
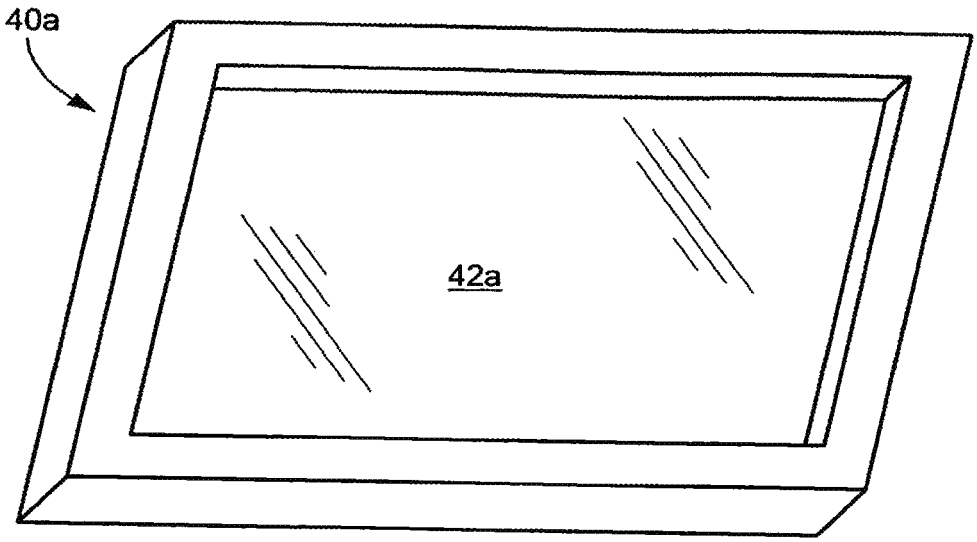
FIG. 5A-5B are schematic three-dimensional top views showing an example of first and second plates used to form the structure of an improved heat exchanger assembly in accordance with the subject disclosure.
Figure 5B:
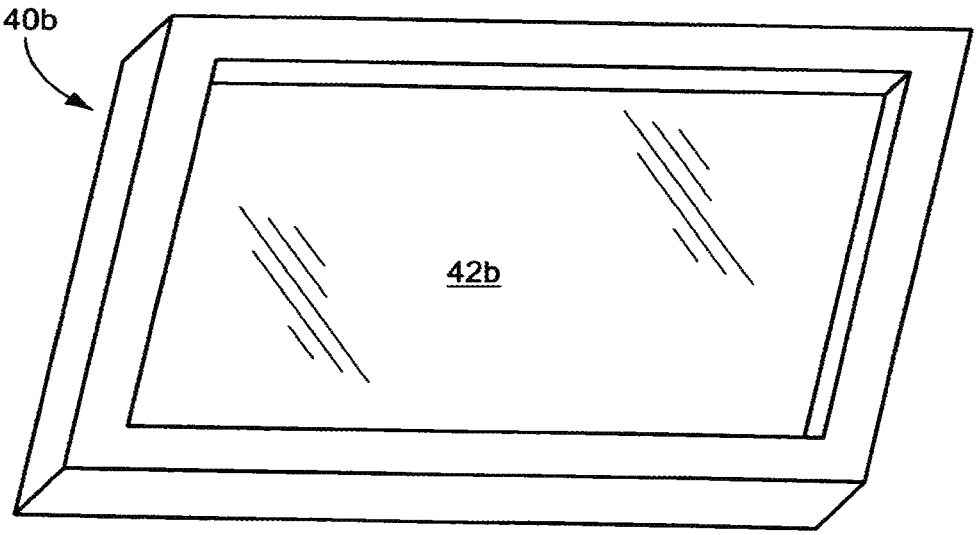
Figure 6:
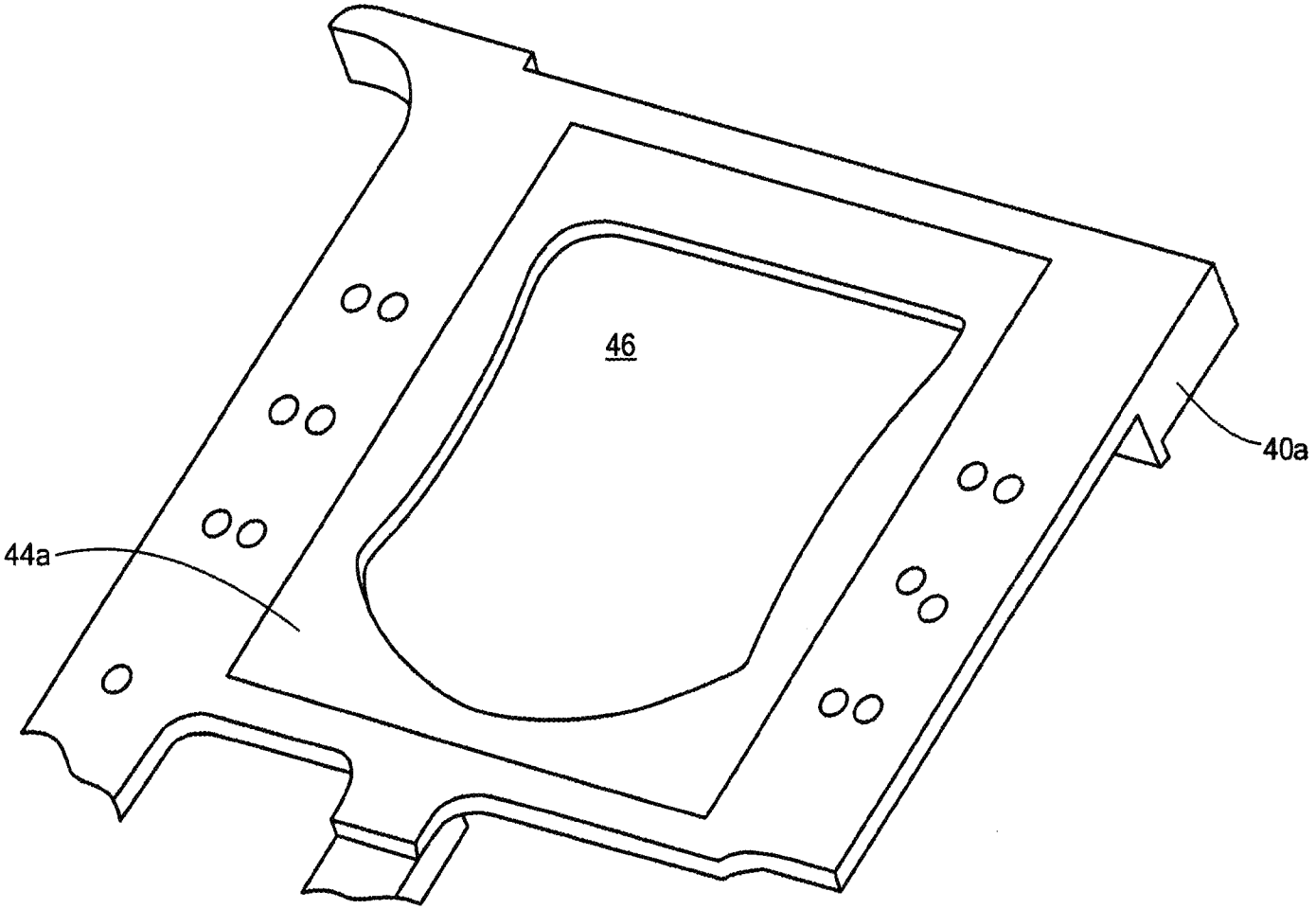
FIG. 6 is a schematic three-dimensional top view showing a particular configuration of cold plate with the wick material installed therein in accordance with one example of the subject disclosure.

FIGS. 5A-5B show first and second plates 40*a* and 40*b* in accordance with an example of the subject disclosure made of a predetermined thermally conductive material (such as aluminum) configured, when mated to form a hermetically sealed vapor chamber. In this particular example, the vapor chamber is formed via machining cavity 42*a* in one face of plate 40*a* and machining cavity 42*b* in one face of plate 40*b*. FIG. 6 shows the addition of aluminum foam wick material 44*a* lining the vapor chamber and forming gas chamber 46. One source of aluminum foam is available from ERG Materials and Aerospace Corp. (Oakland, Calif.) under the brand name "Duocel." Typically, the aluminum foam lines all the walls defining the vapor chamber. The wick material may be formed in place in the chamber.

Figure 7:
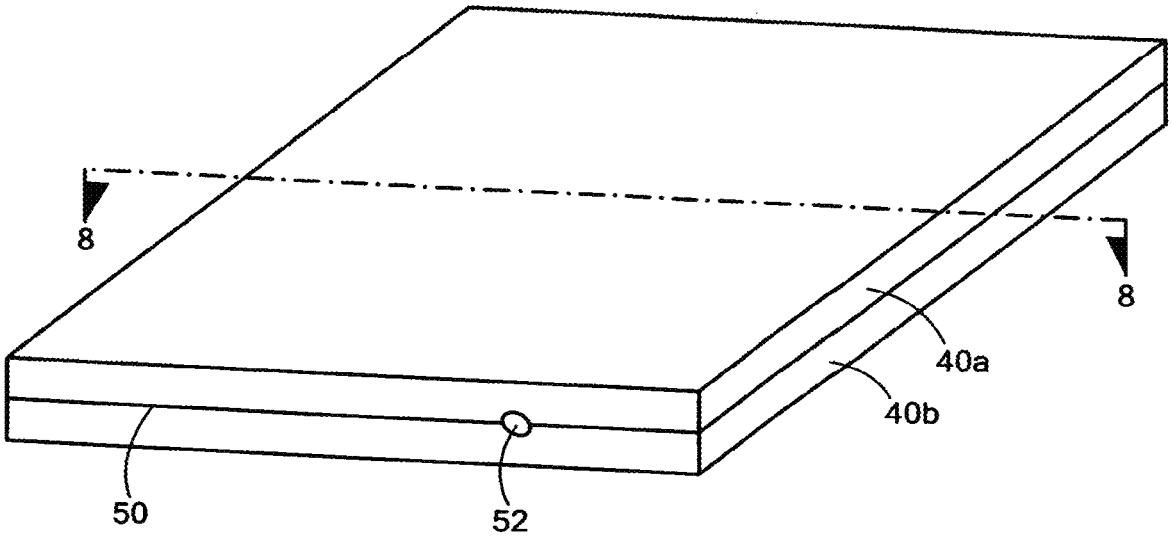
FIG. 7 is a schematic three-dimensional top view showing a completed heat exchanger assembly in accordance with an example of the subject disclosure.

FIG. 7 shows two such plates hermetically sealed via peripheral friction stir weld 50. Stir welding is an autogenous process meaning no additional materials are required which could galvanically corrode. Stir welding also reliably seals plates 40*a* and 40*b* with low distortion while retaining the original mechanical properties of the cold plate material which solder and other joining methods cannot provide. Soldering, bonding, and other techniques can be used to join the plates. If composite materials are used, thermal bonding techniques may be used. Metal foam wick material 44, FIG. 8 in vapor chamber 42 forming chamber 46 is beneficial because it is made of the same material as plates 40*a* and 40*b* and the cell and tendon size can be optimized for the best capillary action for any particular application and chamber configuration. The foam aluminum wick can be sized, shaped, or layered to maximize fluid transfer via capillary action. The chamber size can be optimized and can be designed to maximize gas transfer to the condenser section of the heat exchanger. But, wick material 44 could also be braided aluminum and brazing could also be used to hermetically seal plates 40*a* and 40*b*. The wick material is typically the same as the material forming the chamber but, at the least, the two materials should be galvanically matched.

Figure 8:
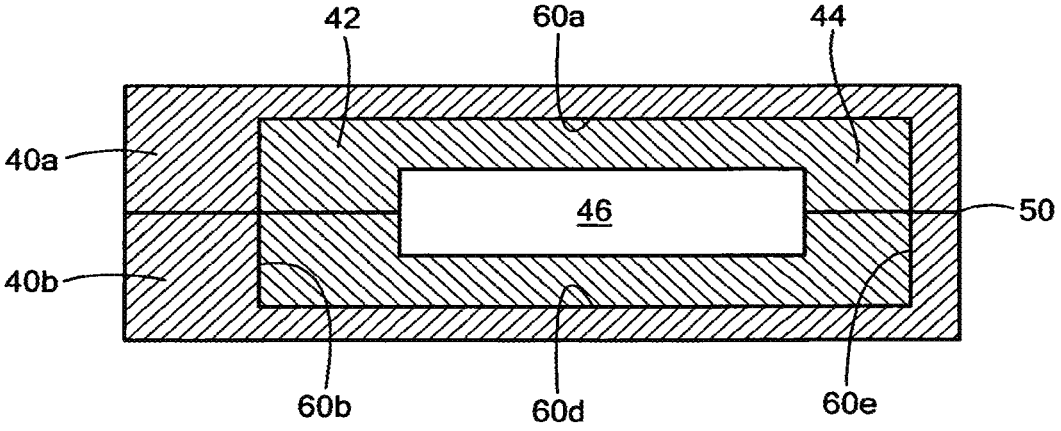
FIG. 8 is a schematic cross-sectional front view of the complete assembly shown in FIG. 7.
Figure 9:
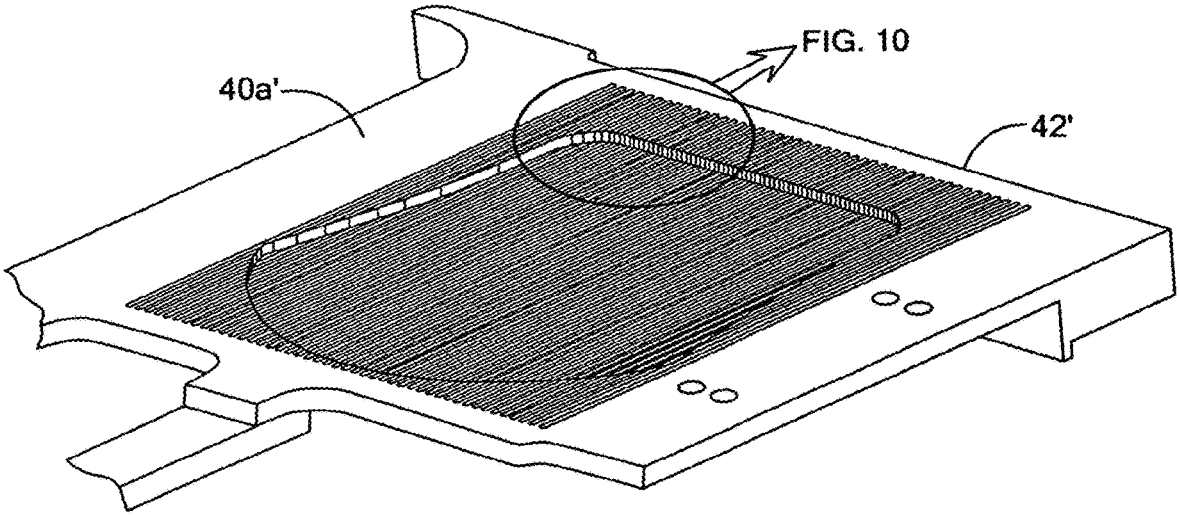
FIG. 9 is a sectional view of a vapor chamber with a finned wick in accordance with the subject disclosure.

FIG. 7 also shows a port into vapor chamber 42, FIG. 8 plugged via aluminum cylinder 52, FIG. 7 inertial welded into the port. Again, if aluminum is used for plates 40*a* and 40*b*, aluminum is preferably used for both the wick material (aluminum foam) and the plug sealing the port. Other choices for all three components are copper and carbon based materials. Conductive composite materials may be used. Wick material 42, FIG. 8 which lines the walls 60*a*-60*e* of the vapor chamber and which defines gas chamber 46 can be placed in the vapor chamber, brazed to the walls of the vapor chamber, foamed in place on the walls of the vapor chamber, or bonded to the walls of the vapor chamber. Metal wick material 44 can be compressed or molded or cast into any desired shape, it can be layered, or machined. The wick may be configured to form fins. A sintered wick or a nanotube wick may be used. Also, although the heat exchanger assembly shown in FIGS. 7-8 includes plates 40*a* and 40*b*, any structure forming a hermetically sealed vapor chamber including a wick made of the same material or a galvanically matched material as the structure is within the scope of the subject disclosure. Gun drilling, casting, machining, EDM, and other processes may be used to form the chamber. And, plates 40*a* and 40*b* can be of any desired size, shape, configuration, and thickness.

Manufacturing a heat exchanger in accordance with the example given above includes machining or otherwise forming cavities 42*a* and 42*b*, FIGS. 5A-5B in a face of plates 40*a* and 40*b*; installing the metallic wick material in each chamber as shown in FIG. 6; hermetically sealing plates 40*a* and 40*b* as shown in FIG. 7 but leaving a port as discussed above; adding a coolant such as water, ammonia, alcohol, or the like to the wick material via the port; heating the assembly until all of the air exits gas chamber 46, FIG. 8; and plugging the orifice as shown at 52 in FIG. 7 (typically by inertia welding).

Figure 10:
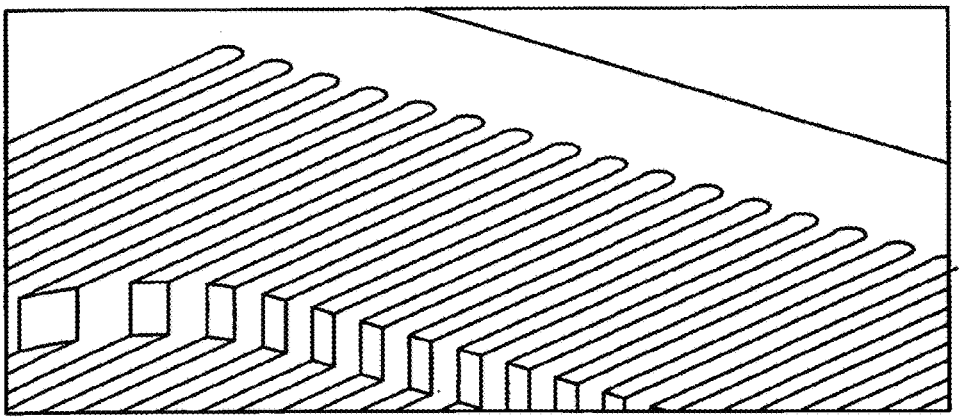
FIG. 10 is a more detailed view of the wick fins.
Figure 11:
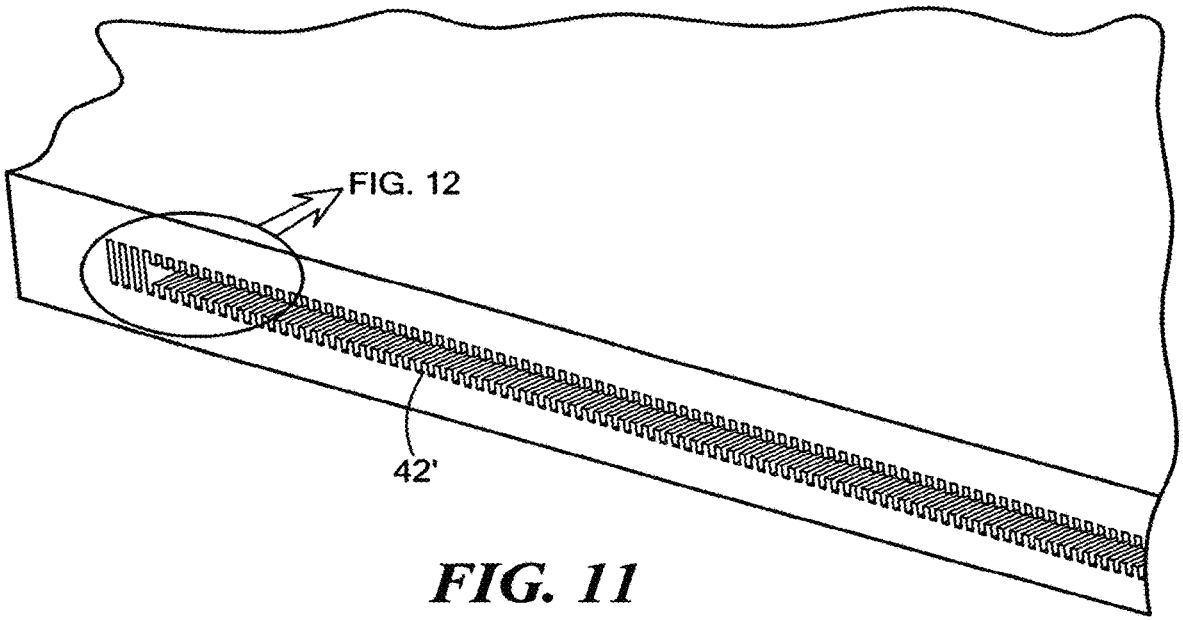
FIG. 11 is a view of the finned wick sectioned across the vapor chamber.
Figure 12:
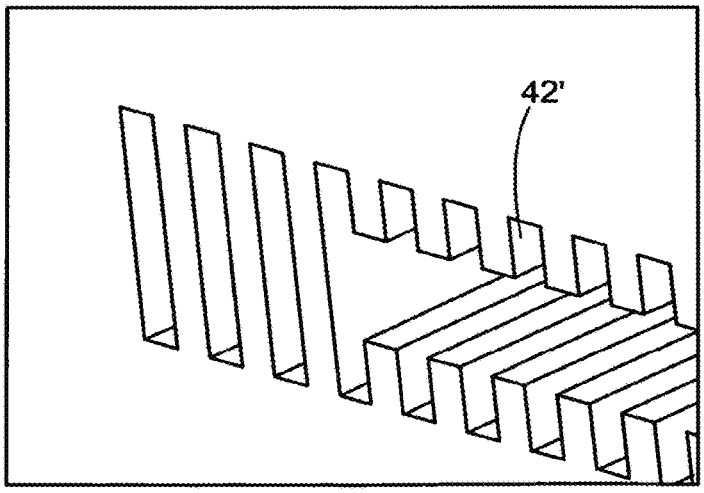
FIG. 12 is another more detailed view of the finned wick.

FIG. 11 shows an embodiment with plate 40*a*' with finned wick 42' therein, also shown in FIGS. 10-12.

Figure 13:
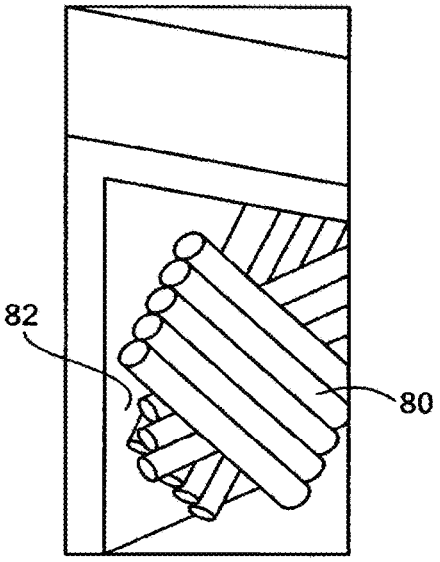
FIG. 13 is a view showing carbon nanotubes added to the fins of the wick.
Figure 14:
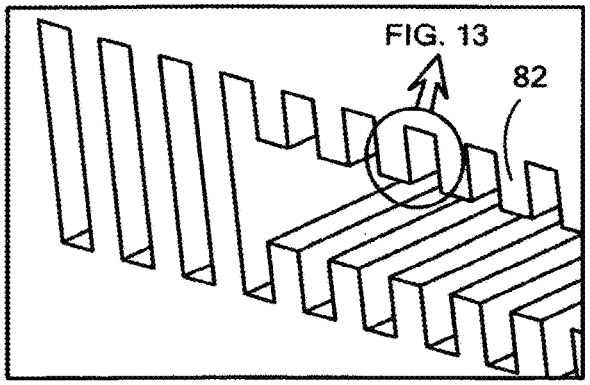
FIG. 14 is a view showing the fins including the carbon nanotubes of FIG. 13.
Figure 15:
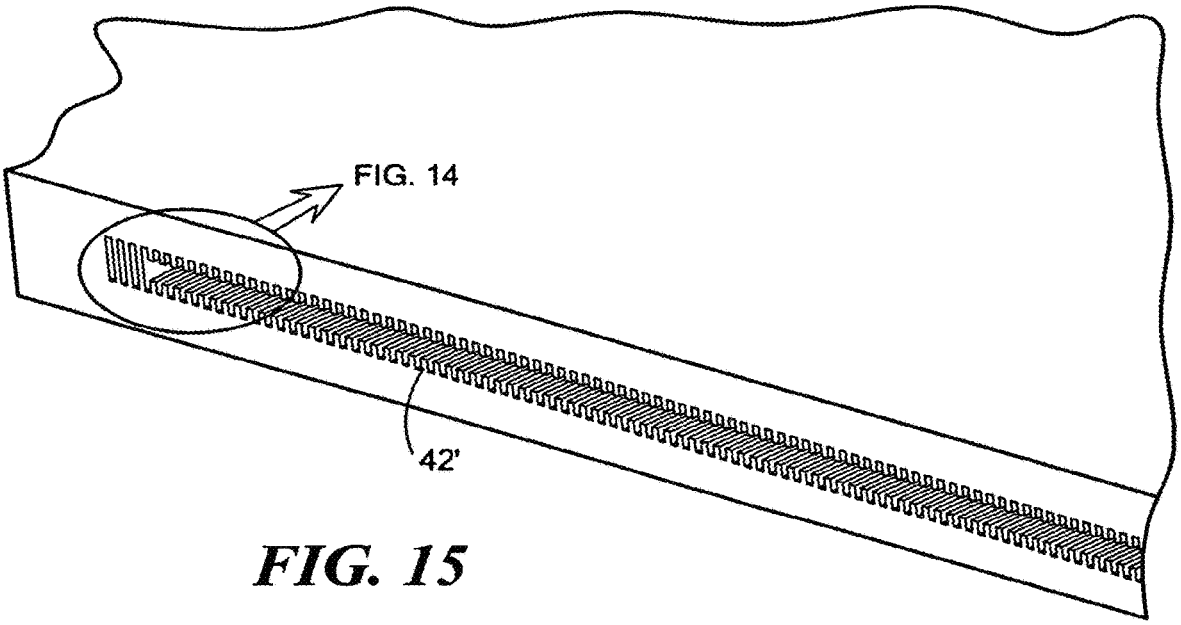
FIG. 15 is a view of a sectioned vapor chamber including the fins of FIG. 14.

In one example, the fin thickness was 0.010" and the fin spacing was 0.010". The result is a custom machined vapor chamber. Varying fin heights and sizes can be used to facilitate and optimize liquid transport via fin wicking. FIGS. 13-15 show another embodiment where a custom machined vapor chamber includes oriented carbon nanotubes 80, FIG. 13, attached to the fins 82, FIGS. 14-15 to improve the wicking action of the liquid cooling medium.

The result in any embodiment is an improved heat exchanger assembly. Because all of the materials used are the same or gavanically compatible, galvanic corrosion is not typically a problem resulting in improved reliability. Because all of the materials used are the same, there is also typically a lower thermal resistance. The heat exchanger assembly of the subject disclosure can be manufactured easily and at a lower cost. If aluminum is used as discussed above for plates 40*a* and 40*b*, for wick 42, and for plug 52 (FIG. 7), the heat exchanger assembly is considerably lighter than a prior art copper based cold plate. A heat exchanger in accordance with the subject disclosure typically has higher cooling capacity and is more efficient. The use of the metal foam material as a wick also has the benefit of increasing the wicking volume and the gas handling volume above and beyond a typical heat pipe capacity. Thermal conductivity is improved because the thermal path only includes one aluminum plate, the foam aluminum wick, and the vapor chamber versus the alternative design with heat pipes wherein the thermal path included a copper plate, an under plate, and over plate, solder, a void or flux, the copper heat pipe, and the sinter material within the copper heat pipe. The use of a three dimensional scalable, flexible form factor integrated vapor chamber, joined by friction stir welding, achieves a synergistic structure that optimizes mechanical strength and thermal properties.

Although specific features of the disclosure are shown in some drawings and not in others, this is for convenience only as each feature may be combined with any or all of the other features in accordance with the disclosure. The words "including", "comprising", "having", and "with" as used herein are to be interpreted broadly and comprehensively and are not limited to any physical interconnection. Moreover, any embodiments disclosed in the subject application are not to be taken as the only possible embodiments. As noted, structures other than plates may be used to form the vapor chamber.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

Other embodiments will occur to those skilled in the art and are within the following claims.

What is claimed is:

1. A heat exchanger assembly, comprising:

first and second plates made of a thermally conductive material configured when mated to form a hermetically sealed vapor chamber;

a wick made of the thermally conductive material in the vapor chamber forming a gas chamber, wherein the wick includes fins each extending continuously from the hermetically sealed vapor chamber toward one of two opposing edges of the first and second plates; and for each of at least one of the fins, multiple layers of carbon nanotubes adjacent to a surface of the fin that is normal to a plane of the plates, each layer of carbon nanotubes oriented obliquely with respect to a direction in which the fin extends from the hermetically sealed vapor chamber, wherein the multiple layers of carbon nanotubes are oriented in different directions, and wherein, within each layer of carbon nanotubes, the carbon nanotubes in that layer of carbon nanotubes are similarly oriented.

2. The heat exchanger assembly of claim 1, wherein the carbon nanotubes increase wicking action by the wick.

3. The heat exchanger assembly of claim 1, wherein at least some of the carbon nanotubes are positioned between adjacent pairs of fins.

4. The heat exchanger assembly of claim 1, wherein the fins have heights and sizes that facilitate liquid transport via fin wicking.

5. The heat exchanger assembly of claim 1, wherein the wick is configured to maximize fluid transfer via capillary action.

6. The heat exchanger assembly of claim 1, wherein the thermally conductive material of the first and second plates is aluminum.

7. The heat exchanger assembly of claim 1, wherein the thermally conductive material of the wick is aluminum.

8. The heat exchanger assembly of claim 1, wherein the wick is made of a metal foam.

9. A heat exchanger assembly, comprising:

first and second plates formed of a thermally conductive material, each plate containing a cavity, the cavities forming a hermetically sealed vapor chamber when the first and second plates are stacked on top of each other with the cavities facing each other;

an aluminum foam wick lining each of the cavities, the aluminum foam wick having a grooved surface defining fins separated by grooves, each of the grooves extending continuously from the hermetically sealed vapor chamber toward one of two opposing edges of the stacked first and second plates, the aluminum foam wick filling peripheral regions of each cavity while leaving a central region of each cavity unfilled, wherein the aluminum foam wick is configured to provide a wicking action of a liquid cooling medium, wherein, for each of at least one of the fins, multiple layers of carbon nanotubes are adjacent to a surface of the fin that is normal to a plane of the plates, each layer of carbon nanotubes oriented obliquely with respect to a direction in which the fin extends from the hermetically sealed vapor chamber, wherein the multiple layers of carbon nanotubes are oriented in different directions, and wherein, within each layer of carbon nanotubes, the carbon nanotubes in that layer of carbon nanotubes are similarly oriented; and a port extending from an outside of the first and second plates into the vapor chamber, wherein the aluminum foam wick is galvanically matched to the thermally conductive material.

10. The heat exchanger assembly of claim 9, wherein a cell size for the aluminum foam wick is selected to facilitate capillary action.

11. The heat exchanger assembly of claim 9, wherein the aluminum foam wick completely surrounds the vapor chamber.

12. The heat exchanger assembly of claim 9, further comprising:

a plug made of the thermally conductive material and placed in the port.

13. The heat exchanger assembly of claim 9, wherein the thermally conductive material includes one of aluminum and carbon composites.

14. The heat exchanger assembly of claim 9, wherein at least a portion of a surface of the aluminum foam wick in each cavity is co-planar with a surface of a respective face of the cavity.

15. The heat exchanger assembly of claim 9, wherein the aluminum foam wick is formed to give the central region of each cavity a size and shape filled by the liquid cooling medium.

16. The heat exchanger assembly of claim 9, further comprising:

a peripheral stir weld hermetically sealing the first and second plates.

17. A heat exchanger assembly, comprising:

first and second plates made of a thermally conductive material, each plate containing a cavity, the cavities forming a hermetically sealed vapor chamber when the first and second plates are stacked on top of each other with the cavities facing each other;

a wick that lines at least one of the cavities, the wick having (i) a flat side in contact with the first or second plate and (ii) a fin side facing the vapor chamber, the fin side comprising fins each extending continuously from one of the cavities toward one of two opposing edges of the first or second plate so as to form an area of a liquid-to-gas boundary; and a wick liner comprising, for each of at least one of the fins, multiple layers of carbon nanotubes adjacent to a surface of the fin that is normal to a plane of the plates, each layer of carbon nanotubes oriented obliquely with respect to a direction in which the fin extends, wherein the multiple layers of carbon nanotubes are oriented in different directions, and wherein, within each layer of carbon nanotubes, the carbon nanotubes in that layer of carbon nanotubes are similarly oriented.

18. The heat exchanger assembly of claim 17, wherein the fins have heights and sizes that facilitate liquid transport via fin wicking.

19. The heat exchanger assembly of claim 17, wherein the wick is configured to maximize fluid transfer via capillary action.

20. The heat exchanger assembly of claim 17, wherein at least some of the carbon nanotubes are positioned between adjacent pairs of fins.

* * * * *